United States Patent [19]

Vornberger

[11] 3,975,932

[45] Aug. 24, 1976

[54] ROUGHING MACHINE HAVING TOOL POSITION ADJUSTING MECHANISM

[75] Inventor: Walter Vornberger, Tewksbury, Mass.

[73] Assignee: International Shoe Machine Corporation, Nashua, N.H.

[22] Filed: Oct. 9, 1975

[21] Appl. No.: 621,188

[52] U.S. Cl. ..... 69/6.5; 12/1 R; 12/77

[51] Int. Cl.[2] ..... C14B 1/44; A43D 95/00

[58] Field of Search ..... 12/1 R, 1 B, 1 F, 77, 12/70, 17 R, 17.2; 69/6.5; 51/98; 91/441

[56] References Cited

UNITED STATES PATENTS

| | | | |
|---|---|---|---|
| 3,077,098 | 2/1963 | Pearsall et al. | 69/6.5 |
| 3,298,048 | 1/1967 | Dziki et al. | 12/17 R |
| 3,843,985 | 10/1974 | Leonhardt | 12/1 R |

*Primary Examiner*—Patrick D. Lawson
*Attorney, Agent, or Firm*—Albert Gordon

[57] ABSTRACT

A roughing machine for roughing the margin of an upper of a shoe assembly comprised of a last having an insole on its bottom and the upper mounted thereon with the margin lying against and being secured to the insole periphery. The machine incorporates a margin control mechanism that enables a roughing tool to engage the upper margin a relatively great distance inwardly of the periphery of the shoe assembly bottom during the passage of portions of the sides of the shoe assembly bottom past the roughing tool and to engage the upper margin a relatively small distance inwardly of the periphery of the shoe assembly bottom during the passage of the remainder of the shoe assembly bottom past the roughing tool.

7 Claims, 14 Drawing Figures

ROUGHING MACHINE HAVING TOOL POSITION ADJUSTING MECHANISM

BACKGROUND AND SUMMARY OF THE INVENTION

U.S. Pat. No. 3,843,985 and U.S. Pat. application Ser. No. 608,616 filed Aug. 28, 1975 disclose roughing machines capable of roughing the margin of an upper of a shoe assembly comprised of a last having an insole located on its bottom and the upper mounted thereon with the upper margin lying against and being secured to the insole periphery. These machines are so constructed as to enable a roughing tool to engage the upper margin a relatively great or a relatively small distance inwardly of the shoe assembly bottom during movement of the upper margin past the roughing tool.

The machines of U.S. Pat. No. 3,843,985 and application Ser. No. 608,616 include: a housing; a roughing tool mounted to the housing for forward-rearward movement; drive means for moving the roughing tool with respect to the housing between forward and rearward positions; a turntable mounted for rotary movement about an upright axis; a slide mounted to the turntable for reciprocal movement in two opposite prone directions between two end positions on the turntable; a shoe assembly support mounted to the slide for supporting the shoe assembly bottom-up; means for first moving the slide with respect to the turntable, while the turntable is stationary, in a first of said directions between said end positions so as to move a first side portion of the upper margin past the roughing tool; means for thereafter rotating the turntable 180 degrees while the slide is stationary relative to the turntable to move an end portion of the upper margin past the roughing tool; means for thereafter moving the slide with respect to the turntable, while the turntable is stationary, in the other of said directions between said end positions to move the second side portion of the upper margin past the roughing tool; and operating means effective during said movements of said upper margin portions past the roughing tool to cause such movements of the housing as to enable the roughing tool to engage the upper margin a relatively great distance inwardly of the periphery of the shoe assembly bottom when the roughing tool is in said forward position and to enable the roughing tool to engage the upper margin a relatively small distance inwardly of the periphery of the shoe assembly bottom when the roughing tool is in said rearward position.

In the machine of application Ser. No. 608,616, a control member is mounted to the turntable and an actuating member is mounted for movement with the slide in said directions with said members being so constructed and arranged as to be in non-intersecting relationship at the beginning of the slide movement in said first of said directions and at the end of the slide movement in said other of said directions and to be in intersecting relationship during a first prescribed portion of the slide movement in said first of said directions and during a second prescribed portion of the slide movement in said other of said directions. Adjusting means so connect said members to the drive means as to cause the drive means to place the roughing tool in one of said positions when said members are in non-intersecting relationship and to place the roughing tool in the other of said positions when said members are in intersecting relationship.

In the machine of application Ser. No. 608,616, the boundaries on the opposite sides of the shoe assembly between the portions wherein the roughing tool is caused to be placed a relatively great distance inwardly of the shoe assembly bottom and a relatively small distance inwardly of the shoe assembly bottom are not laterally offset from each other, which has proven to be disadvantageous as the sides of the shoe assembly are not symmetrically disposed about the longitudinal center line of the shoe assembly. In order to overcome this disadvantage, in accordance with a first aspect of this invention, the control and actuating members are so constructed and arranged that said first and said second prescribed portions of the slide movements are laterally offset from each other to thereby laterally offset the boundaries on the opposite sides of the shoe assembly referred to above.

The machine of application Ser. No. 608,616 includes: a post rigidly mounted to the slide; a backpart shoe assembly suppoting element mounted to the post; a stand mounted to the slide for movement towards and away from the post; a forepart shoe assembly supporting element mounted to the stand; means for moving the stand towards the post from an initial stand position to a working stand position through a distance that is inversely proportional to the length of a shoe assembly that is supported on the backpart supporting element to thereby enable the forepart supporting element to be placed in a supportive position with respect to the shoe assembly; and co-operative terminating means mounted to the stand and to the turntable for defining one of said end positions. With this arrangement, the end of the slide movement pursuant to the movement of the slide in said first of said directions is defined by the terminating means. The movement of the slide is said first of said directions causes relative movement extending from the heel of the shoe assembly towards the toe of the shoe assembly of the roughing tool with respect to the upper margin to take place, the 180 degree rotation of the turntable causes the toe portion of the upper margin to move past the roughing tool, and the movement of the slide in said other of said directions causes relative movement extending from the toe of the shoe assembly towards the heel of the shoe assembly of the roughing tool with respect to the upper margin to take place. The control member is in the form of a normally open regulator that is movable between open and closed portions and the actuating member is is in the form of a cam that is mounted to the stand for movement in unison with the movement of the stand towards the post from an initial actuating member position to a working actuating member position and mounted for movement with the slide in said directions. The aforementioned non-intersecting relationship takes place when the cam is disengaged from the regulator and the aforementioned intersecting relationship takes place when the cam is in engagement with the regulator to thereby close the regulator. The cam is so mounted to the stand and to the turntable as to cause the cam to move from the initial actuating member position to the working actuating member position at a greater speed than the speed of movement of the stand from the initial stand position to the working stand position to thereby cause the distance between the initial and working actuating member positions to be greater than the distance between the initial and working stand positions so as to provide the advantages disclosed in application Ser. No. 608,616.

A second aspect of this invention is concerned with an improved, more accurate and more reliable construction for causing the cam to move at a greater speed than the stand. This construction comprises: a first rack secured to the slide; a second rack movably mounted to the stand for movement in directions that are parallel to the aforementioned prone directions; a gear train so connecting the racks as to cause the second rack to move towards the post during the movement of the stand towards the post at a greater speed than the speed of movement of the stand towards the post; and a connection of the cam to the second rack for movement in unison with the second rack.

In the machine of application Ser. No. 608,616, the actuating members are so constructed and arranged that the members are in non-intersecting relationship at the commencement of the slide movement in the first of the aforementioned directions, are placed in intersecting relationship during the slide movement in this first direction, remain in intersecting relationship during the turntable rotation and after the commencement of the slide movement in the second of the aforementioned directions, and are placed in non-intersecting relationship during the slide movement in this other direction. As a result, the roughing tool roughs the upper margin between the ball breaks and around the toe of the shoe assembly relatively close to the periphery of the shoe assembly bottom and roughs the remainder of the upper margin relatively far from the periphery of the shoe assembly bottom.

It has been found to be desirable, when the concave side portions of the shoe assembly bottom are moving past the roughing tool, to have the brush relatively far from the periphery of the shoe assembly bottom and to have the roughing tool relatively close to the periphery of the shoe assembly bottom during the movement of the remainder of the periphery of the shoe assembly bottom past the roughing tool. A third aspect of this invention is concerned with a modification of the machine of application Ser. No. 608,616 that enables this to take place. In accordance with this aspect of the invention, a cam assembly that includes the aforementioned cam, and the regulator are so located that the cam assembly is disengaged from the regulator at the beginning and the end of each of the aforementioned slide movements and is in engagement with the regulator to move the regulator from its normally open to its closed position during the remainder of each of the slide movements. The regulator and the drive means are so connected to each other that the roughing tool is placed in its rearward position when the regulator is open and is placed in its forward position when the regulator is closed.

DESCRIPTION OF THE PREFERRED EMBODIMENT

Figure 1:
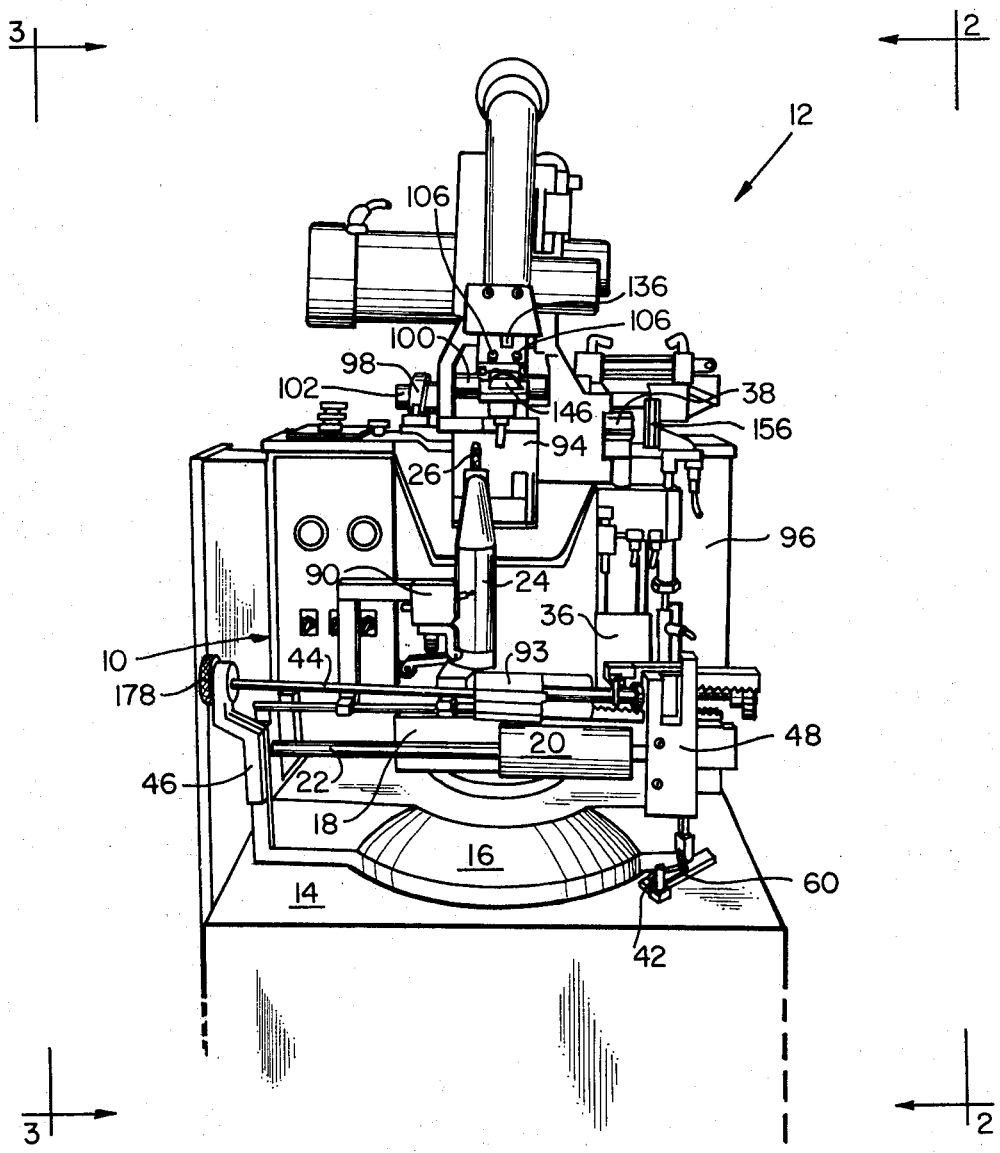
FIG. 1 is a front elevation of the machine.
Figure 2:
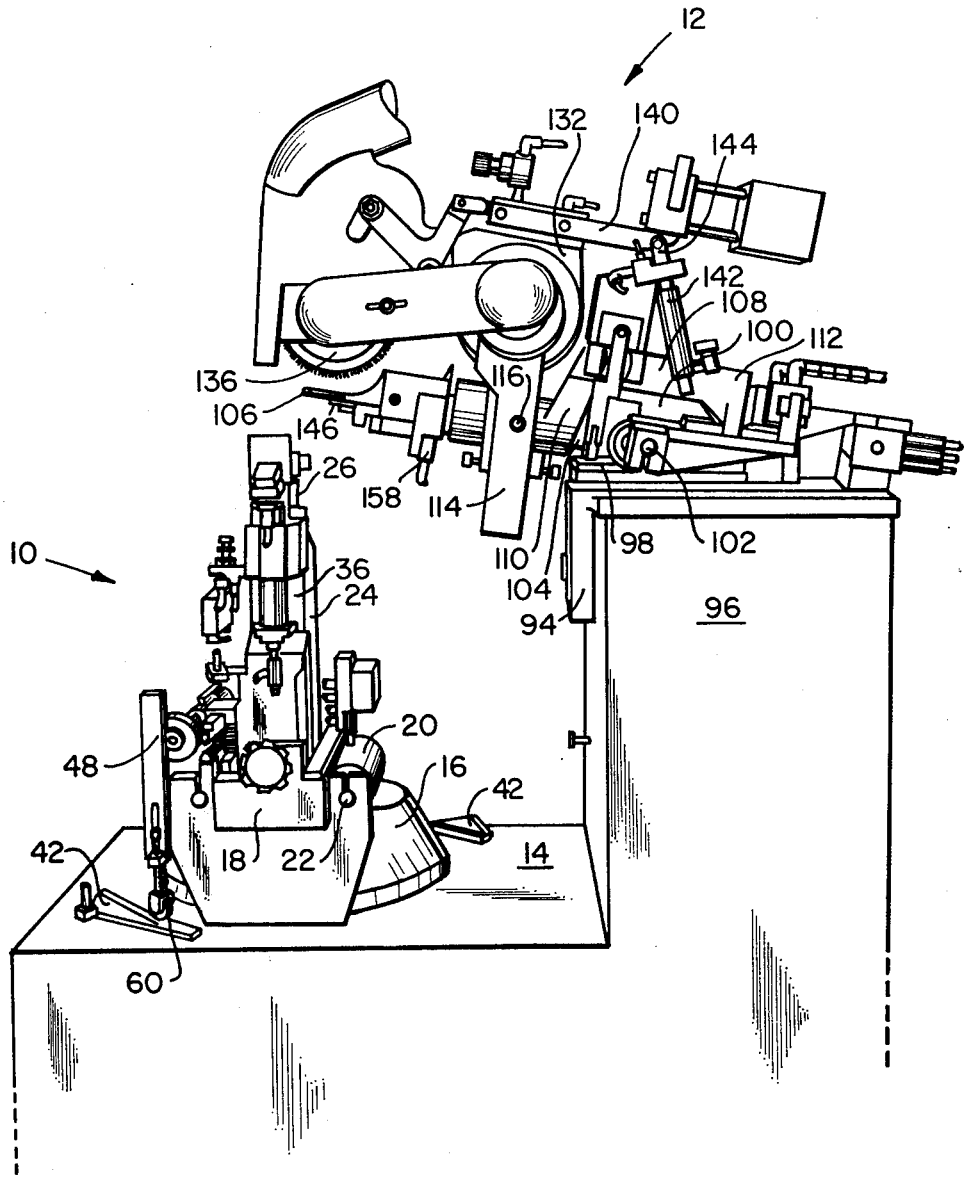
FIGS. 2 and 3 are side elevations of the machine respectively taken along the lines 2—2 and 3—3 of FIG. 1.
Figure 3:
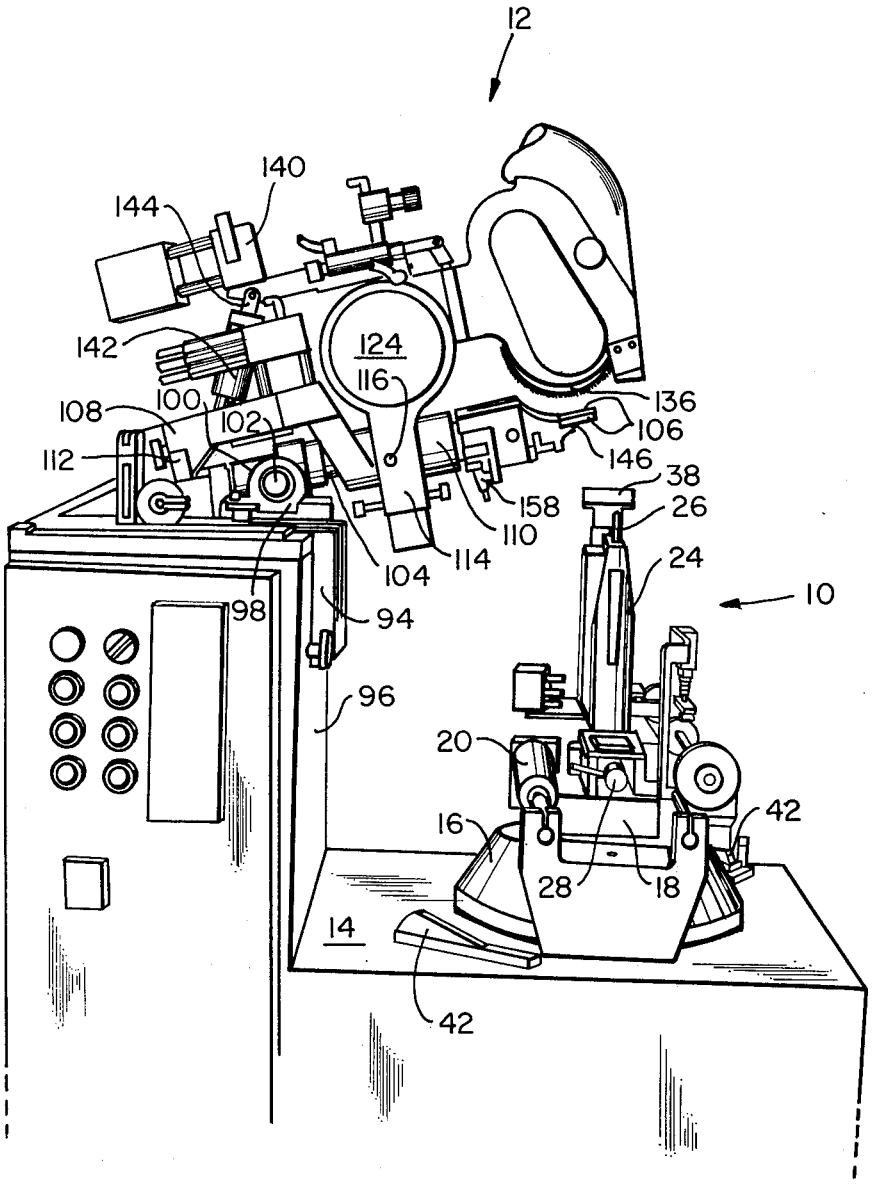

The operator is intended to stand in front of the machine as seen in FIG. 1, to the left of the machine as seen in FIG. 2 and to the right of the machine as seen in FIG. 3. Directions extending toward the operator will be designated as "forward" and directions extending away from the operator will be designated as "rearward." The front of the machine is closest to the operator and the back of the machine is furthermost from the operator.

The machine, as shown in FIGS. 1–3, includes a shoe assembly mount section 10 and a tool section 12 located rearwardly of the section 10.

Figure 4:
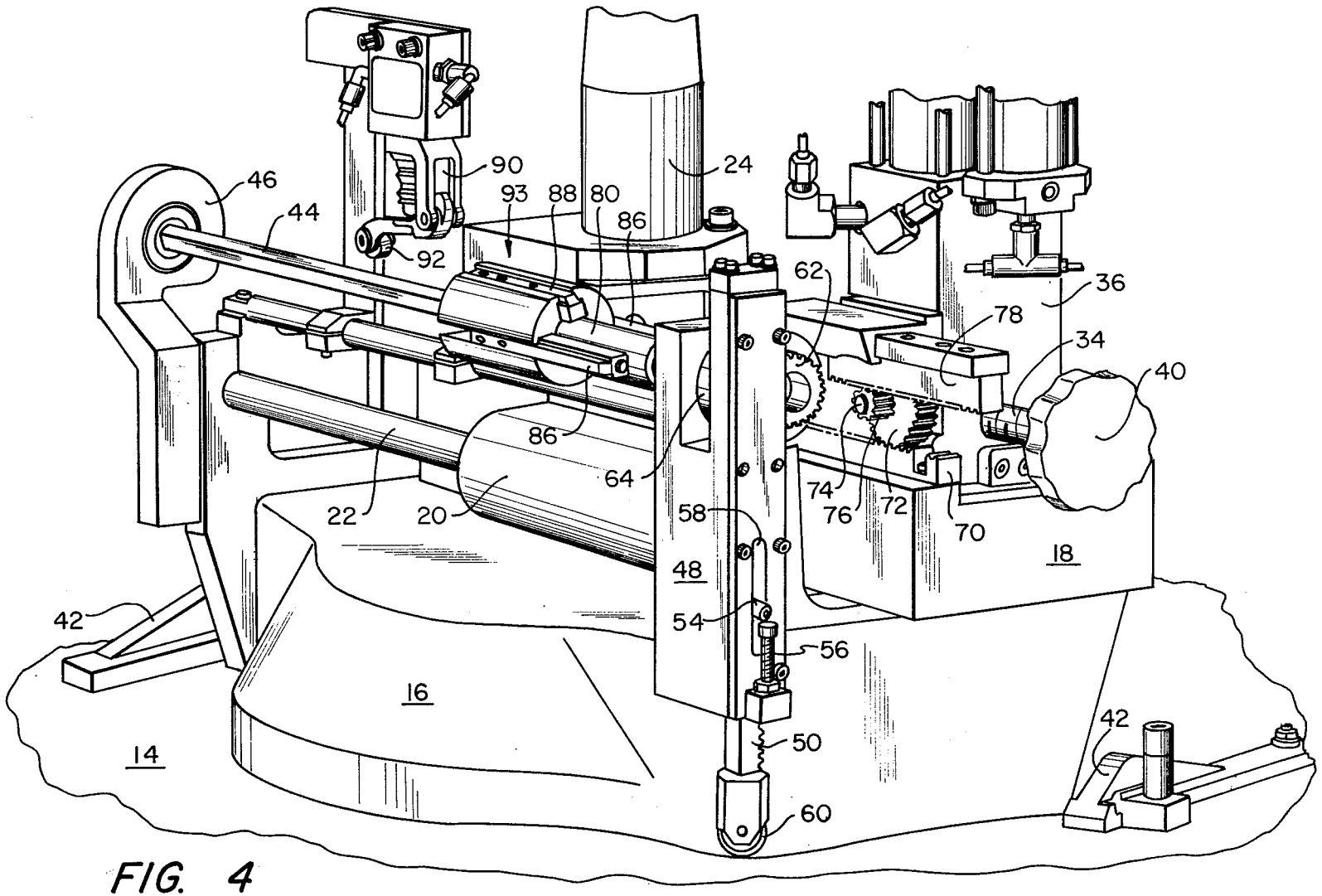
FIG. 4 is an isometric view of the turntable and the slide.
Figure 5:
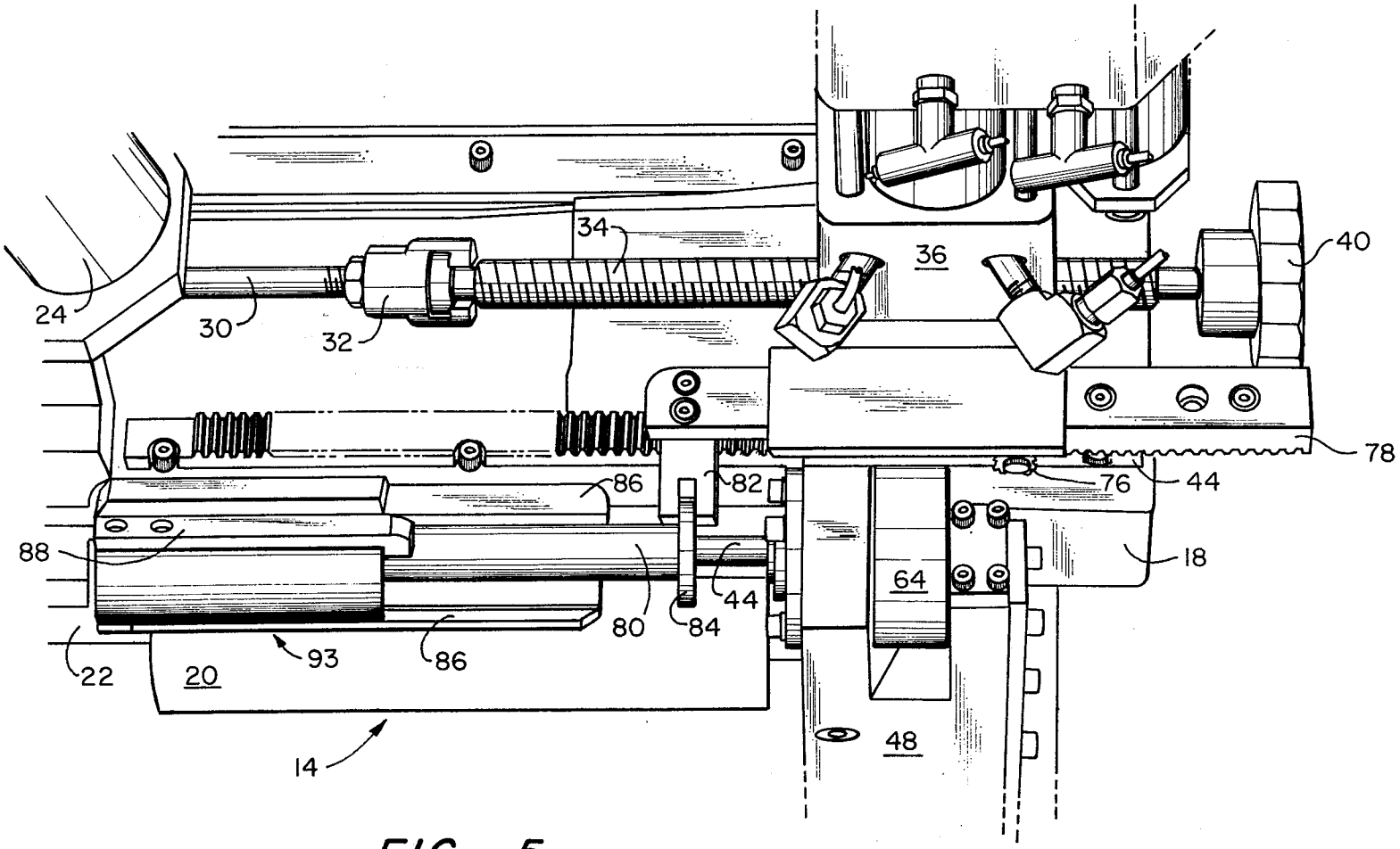
FIG. 5 is a top view of the turntable and the slide.

Referring to FIGS. 4 and 5, the section 10 includes a stationary base 14 having a turntable 16 mounted thereto for rotation in a horizontal plane about a fixed vertical axis. A slide 18 is slidably guided in the turntable 16 for reciprocal motion in a horizontal plane between two end positions on the turntable 16 by means of bushings 20 on the slide 18 that are slidable on rods 22 that are affixed to and extend across the top of the turntable 16.

A post 24 is rigidly mounted to the slide 20 and a last pin 26, that acts as a shoe assembly supporting element, extends upwardly of the post 26. An air operated motor 28 (FIG. 3) is rigidly mounted to the post 24. The piston rod 30 (FIG. 5) of the motor 28 is secured to one end of a bracket 32 and a bolt 34 is rotatably mounted to the other end of the bracket 32. The bolt 34 is threaded into a stand 36. The stand 36 is slidably guided, in the slide 18 in the manner shown in application Ser. No. 608,616, for reciprocating motion in directions that are parallel to the directions of reciprocating motion of the slide 18 in the turntable 16. The stand 36 has extending upwardly thereof a toe pad 38 that acts as a shoe assembly supporting element. A knob 40 is affixed to the end of the bolt 34 that is remote from the bracket 32.

Figure 4A:
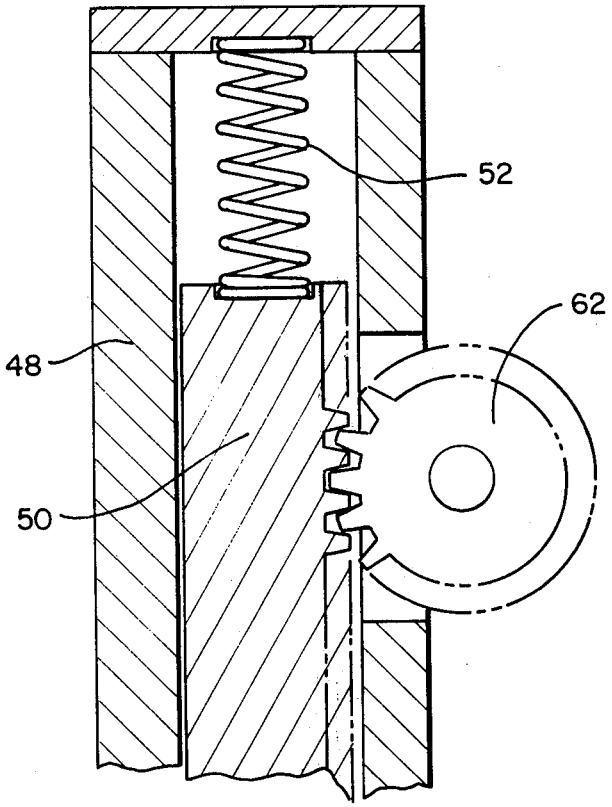
FIG. 4A is a section of a rack and pinion train that forms part of a mechanism for causing the aforementioned lateral offsetting of the first and second prescribed portions of the slide movements.

A pair of cams 42 are mounted to the base 14 outwardly of the turntable 16 and are spaced approximately 180° apart about the periphery of the turntable 16. A rod 44, that is square in cross section, extends between and is rotatably mounted in a pair of posts 46 and 48 that are mounted to the turntable 16, the rod 44 being parallel to the directions of reciprocating motion of the slide 18 in the turntable 16. Referring to FIGS. 4 and 4A, a rack 50 is mounted in the post 48 for heightwise movement and is yieldably urged downwardly by a spring 52 so as to yieldably urge a pin 54 mounted to the rack 50 into engagement with a stud 56 mounted to the post 48, a vertical slot 58 in the post 48 permitting heightwise movement of the pin 54 in the post 48. A cam follower 60 at the bottom of the rack 50 is yieldably urged by the spring 52 into engagement with the base 14. The cam follower 60 is so mounted as to intersect the cams 42 during the rotation of the turntable 16, as described below, such intersection causing the cam follower 60 and the rack 50 to rise upwardly and then downwardly of the post 48.

The top of the rack 50 is in mesh with a pinion 62. The pinion 62 is connected to the rod 44 through a conventional one way clutch 64 (FIGS. 4 and 5) so constructed that rotation of the pinion 62 in one direction pursuant to upward movement of the rack 50 causes corresponding rotation of the rod 44 while rotation of the pinion 62 in the other direction pursuant to downward movement of the rack 50 does not cause corresponding rotation of the rod 44.

As shown in FIG. 4, a rack 70 secured on the slide 18 extends parallel to the rod 44. The rack 70 is in mesh with a gear 72 that is rotatably mounted to the stand 36 by means of a pin 74. A gear 76, of smaller diameter than the gear 72, is so mounted to the pin 74 as to rotate in unison with the gear 72. The gear 76 is in mesh with a rack 78 that is slidably mounted to the stand 36 for movement in directions that are parallel to the directions of movement of the stand 36 in the slide 18.

As shown in FIG. 5, a collar 80 is mounted for sliding movement on the rod 44. The collar 80 has a square internal cross section that mates with the cross section of the rod 44 whereby rotation of the rod 44 will cause corresponding rotation of the collar 80. A fork 82 secured to the rack 78 straddles a flange 84 secured to the collar 80 to enable movement of the rack 78 with respect to the stand 36 to cause corresponding movement of the collar 80 with respect to the rod 44.

A first pair of cams 86 is mounted to the collar 80 so as to extend parallel to the rod 44, the cams 86 being spaced 180 degrees apart about the rod 44. A second set of cams 88 of different length than the cams 86 (only one of which is shown in FIGS. 4 and 5) are mounted to the collar 80 so as to also extend parallel to the rod 44, the cams 88 being located equidistantly between the cams 86 and also being spaced 180 degrees apart about the rod 44. A valve 90 (FIG. 4), mounted to the turntable 16, has a valve actuator 92 that is in registry with that one of the cams 86 or 88 that faces upwardly so as to be intersected by this cam during movement of the slide 18 relative to the turntable 16 as described below. The cams 86 and 88 constitute a cam bank or cam assembly 93.

Figure 6:
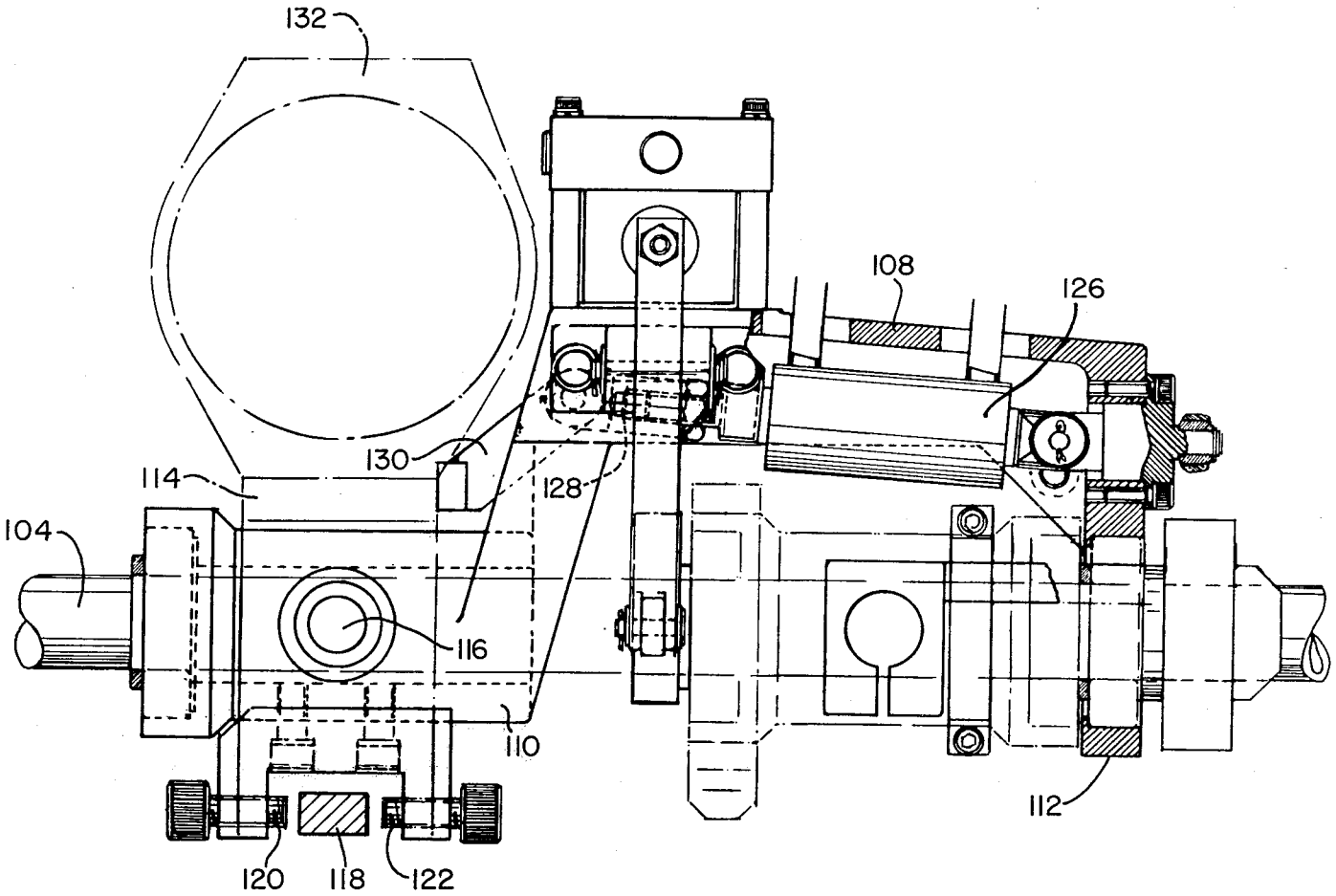
FIG. 6 is a view of a part of the machine that incorporates the aforementioned drive means.
Figure 7:
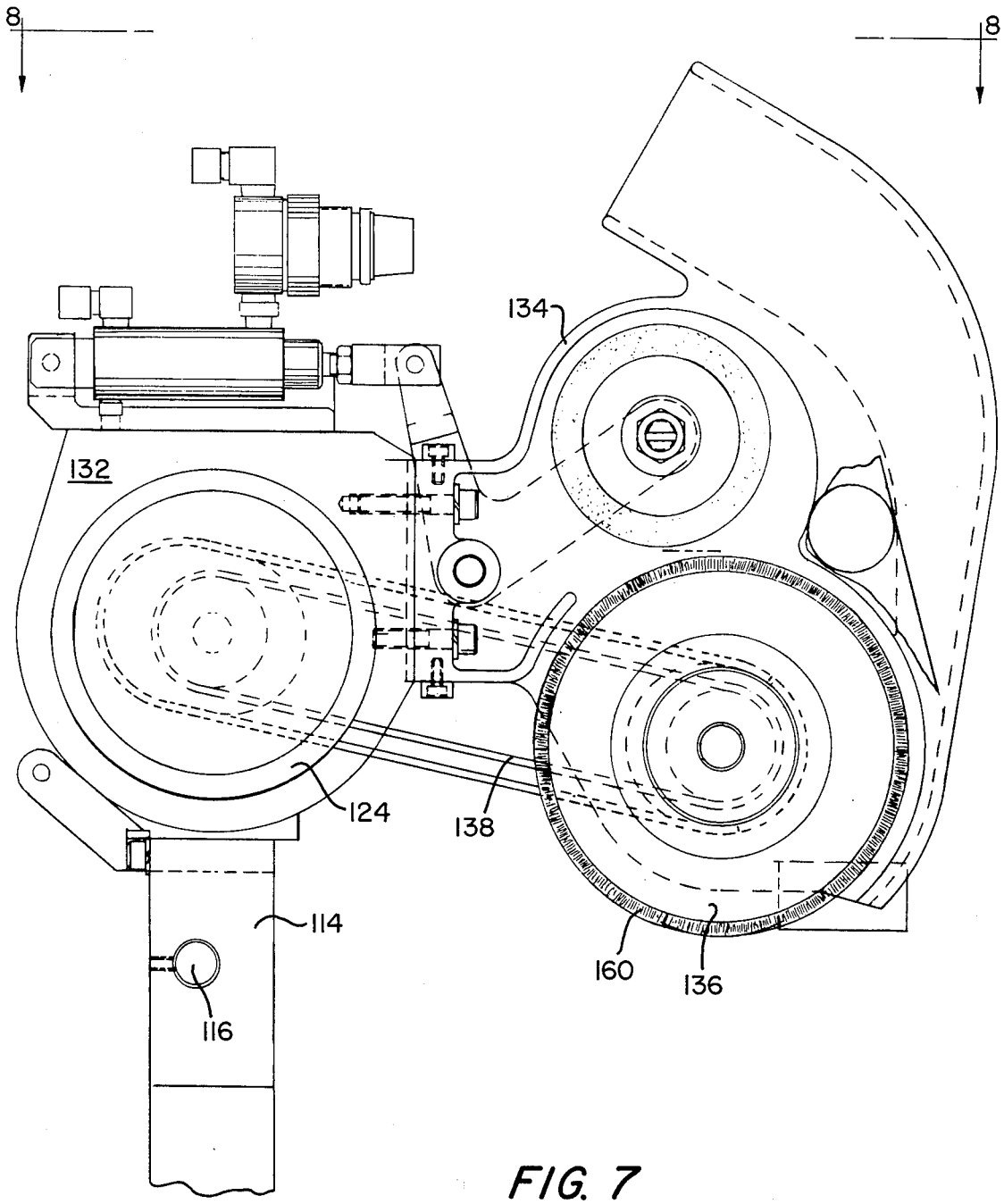
FIG. 7 is a view of a part of the machine that incorporates the roughing tool and a drive for rotating the roughing tool.
Figure 8:
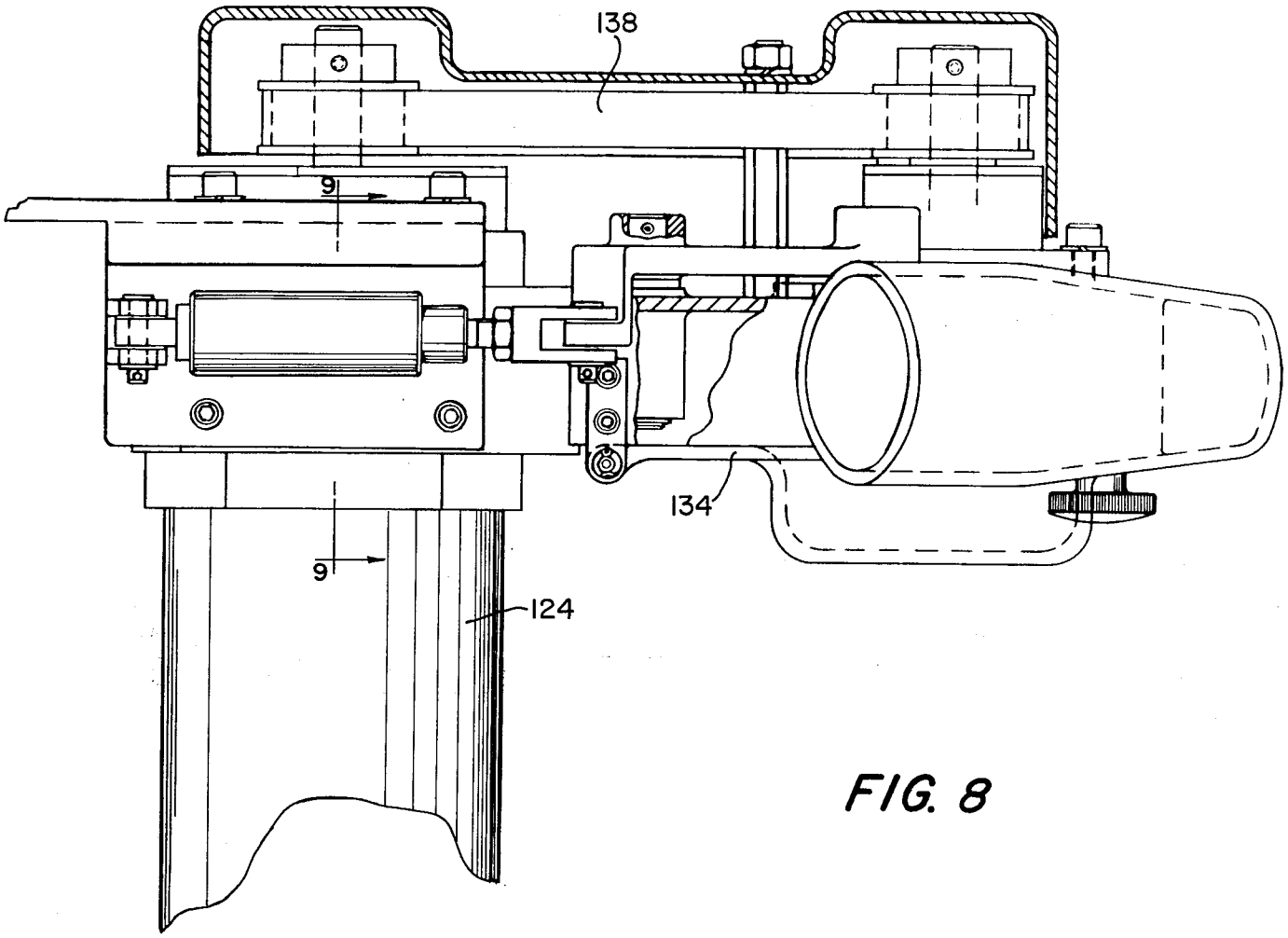
FIG. 8 is a view taken along the line 8—8 of FIG. 7.
Figure 9:
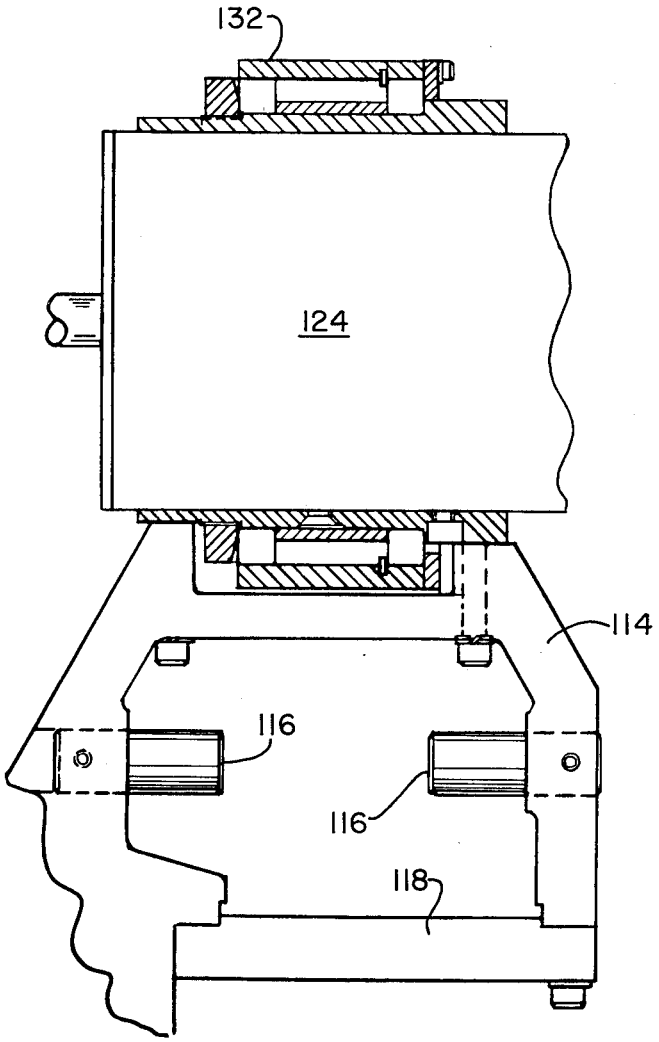
FIG. 9 is a section taken along the line 9—9 of FIG. 8.

Referring to FIGS. 1-3, the tool section 12 includes a slide 94 that is mounted for forward-rearward movement in a frame 96. Trunnions 98 on the slide pivotally mount a yoke 100 for swinging movement about the horizontal axis of spindles 102 that are rigid with the yoke 100 and that are rotatably mounted in the trunnions 98. A hollow shaft 104 extends forwardly and rearwardly through the yoke 100 and is so mounted in the yoke 100 that it is rotatable about its longitudinal axis but is fixed against forward-rearward movement in it. A pair of fork tines 106 is anchored to the front of the shaft 104. A housing 108 (FIG. 6) is rotatably mounted for swainging movement about the longitudinal axis of the shaft 104 by means of a front trunnion 110 and a back trunnion 112 on the housing 108, the trunnions being so mounted to the shaft 104 as to be locked against forward-rearward movement on the shaft.

Referring to FIGS. 6–9, a mount 114 is pivoted by pins 116 to the front trunnion 110 of the housing 108 for forward-rearward movement about the axis of the pins 116. A bar 118 on the mount 114 is located between a front stop 120 and a back stop 122 that are mounted to the front trunnion 110. An electric motor 124 is rigidly mounted to the mount 114 above the front trunnion 110. An air operated motor 126, mounted to the back trunnion 112, has a forwardly directed piston rod 128 that is pivoted to a bracket 130 secured to the mount 114 whereby the motor 126 can effect forward-rearward movement of the mount 114 about the axis of the pins 116.

A housing 132 is rotatably mounted to the motor 124 for swinging movement about the axis of the motor 124. A tool holder 134, mounted to and extending forwardly of the housing 132, rotatably mounts a roughing tool in the form of a wire brush 136. The motor 124 and the brush 136 are drivingly connected by a belt 138 so as to enable the motor 124 to rotate the brush 136. As shown in FIG. 1, the brush 136 is located proximate to and between the fork tines 106.

A counterweight assembly 140 (FIGS. 2 and 3) is affixed to the housing 132. An air operated motor 142 is interposed between the housing 108 and the counterweight assembly is mounted to the housing 108 with the upwardly projecting piston rod 144 of this motor being connected to the counterweight assembly so that the motor 142 may effect heightwise movement of the brush 136 about the axis of the motor 124.

Referring to FIGS. 1–3, a sensing member 146 is located beneath the fork tines 106 and is mounted for forward-rearward movement with respect to the shaft 104 in the manner disclosed in application Ser. No. 608,616.

In the idle condition of the machine; the piston rod 30 is projected out of the motor 28 to place the stand 36 and the toe pad 38 carried thereby relatively remote from the post 24 and the last pin 26; the slide 18 is at one of the end positions on the turntable 16; the last pin 26 is in substantial alignment with the axis of rotation of the turntable 16 and is in substantial forward-rearward alignment with the brush 136; the turntable 16 is locked against rotation; the slide 94, together with the fork tines 106, the roughing brush 136 and the sensing member 146, is in a rearward position; the front of the shaft 104 is swung upwardly about the axis of the spindle 102 to thus place the fork tines 106, the roughing brush 136 and the sensing member 146 in an upper position; the electric motor 124 is operative to rotate the brush 136; the piston rod 128 is retracted into the motor 126 to thereby swing the mount 114, together with the brush 136, rearwardly about the axis of the pins 116 to a position wherein the bar 118 engages the front stop 120 in which position the brush 136 is in a relatively rearward position with respect to the sensing member 146; and the piston rod 144 is retracted into the motor 142 to thus position the brush 136 in a relatively elevated position with respect to the fork tines 106.

Figure 10:
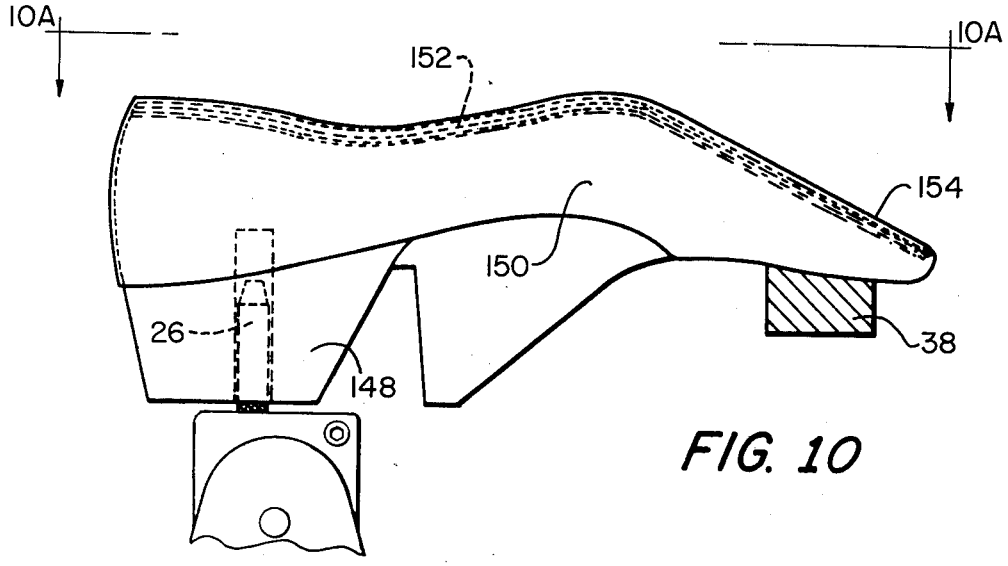
FIG. 10 is a side elevation of a shoe assembly mounted in the machine.
Figure 10A:
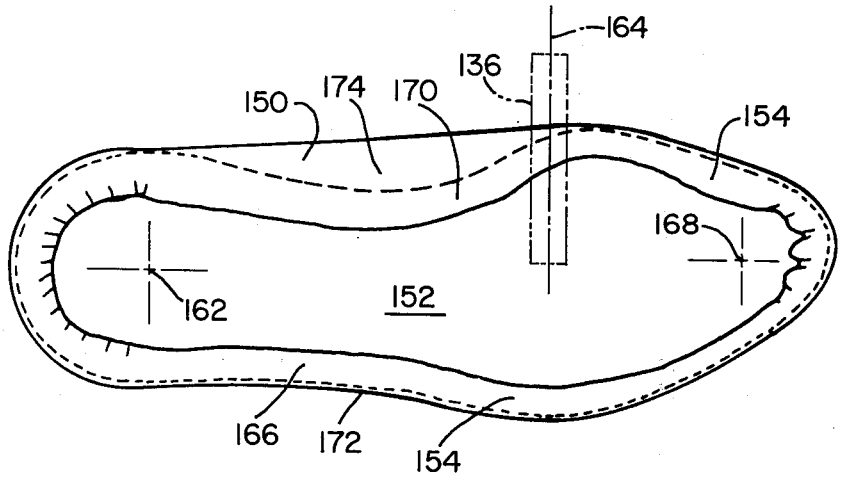
FIG. 10A is a view taken along the line 10A—10A of FIG. 10.

FIGS. 10 and 10A show a shoe assembly that comprises a last 148 having an upper 150 mounted thereon and an insole 152 mounted to its bottom. The upper 150 has been lasted so that the upper margin 154 lies against and is secured to the insole and extends inwardly of the periphery of the insole and of the shoe assembly bottom.

The shoe assembly is mounted by the operator bottom-up on the last pin 26, with the last pin entering the conventional thimble hole in the top of the last, in such a manner that the toe end of the shoe assembly faces the stand 36. In the manner shown in application Ser. No. 608,616, the operator so actuates the motor 28 as to cause the piston rod 30 to be retracted into the motor 28 so as to move the stand 36 together with the toe pad 38 towards the post 24. By mechanism shown in application Ser. No. 608,616, this movement continues until a toe stop 156 (FIG. 1) engages the toe end of the shoe assembly, after which the stand 36 is locked to the slide 18 in the position it had assumed when the top stop 156 engaged the toe end of the shoe assembly, the toe pad 38 is raised into engagement with the forepart of the shoe assembly so as to lock the shoe assembly to the shoe assembly supporting elements 26 and 38 and thus lock the shoe assembly to the slide 18 for the below described roughing operation, and the toe stop 156 is lowered out of engagement with the shoe assembly. During this movement of the stand, the drive train formed by the rack 70, the gears 72 and 76, the rack 78, the fork 82 and the flange 84 enables the collar 80 and the cam bank 93 to move in the same direction as the stand 36 towards the valve actuator 92 at a faster speed than the speed of movement of the stand 36 for reasons that will be explained below.

After the shoe assembly has been locked to the slide 18, mechanism shown in application Ser. No. 608,616 causes the front of the shaft 104 to be lowered to thereby lower the fork tines 106, the roughing tool 136 and the sensing member 146 about the axis of the spindles 102 until the fork tines 106 engage the upper margin 154 in one of the breast line regions (FIGS. 11 and 11A), the shoe assembly being so located that the fork tines will intersect its bottom during their descent and the sensing member will be located outwardly of the shoe assembly when the fork tines engage the shoe assembly.

Figure 11:
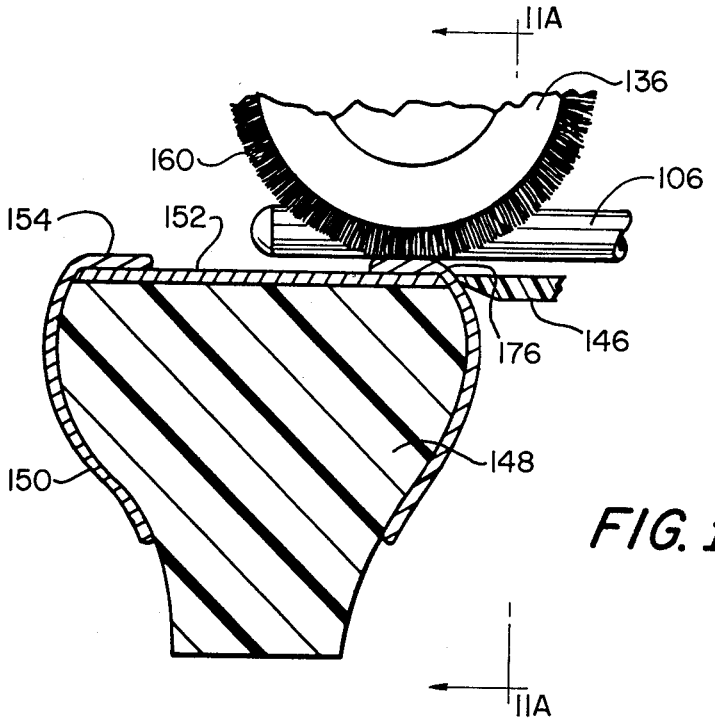
FIG. 11 is a section showing the shoe assembly and the shoe assembly engaging parts of the machine at the beginning of a roughing operation.
Figure 11A:
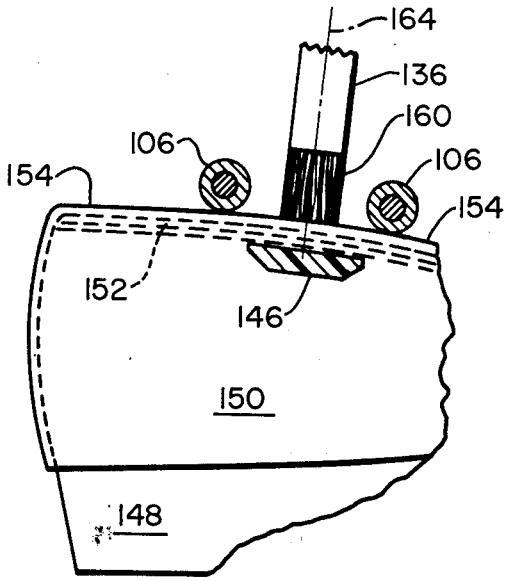
FIG. 11A is a view taken along the line 11A—11A of FIG. 11.

In response the the engagement of the fork tines 106 with the upper margin 154, a valve 158 (FIGS. 2 and 3) is shifted in the manner disclosed in application Ser. No. 546,223 filed Feb. 3, 1975 which causes the slide 94 to move forwardly, together with the fork tines 106, the roughing tool 136 and the sensing member 146, until the sensing member 146 engages the side of the shoe assembly. The shifting of the valve 158, after a time delay sufficient to enable the sensing member 146 to engage the side of the shoe assembly, also causes the motor 142 to project its piston rod 144 upwardly to thereby swing the roughing tool 136 downwardly about the axis of the motor 124 until radially projecting bristles 160 on the brush 136 engage the upper margin 154 between the fork tines 106, as indicated in FIGS. 11 and 11A.

The shifting of the valve 158, after the time delay referred to in the preceding sentence and by mechanism shown in application Ser. No. 608,616, causes the turntable 16 to be unlocked for rotation and effects a first 180° rotation of the turntable 16 about its axis of rotation about a center that is substantially in alignment with the last pin 26 and that lies approximately at the center of curvature, indicated by number 162 in FIG. 10A, of the heel portion of the shoe assembly.

From the foregoing, it can be seen that the engagement of the fork tines 106 causes a lowering of the rotating brush 136 into engagement with the upper margin 154 and a movement of the heel portion of the upper margin past the rotating brush. This arrangement enables the bristles 160 of the rotating brush 136 to abrade or rough the upper margin 154 as it is moving past the brush.

During the movement of the heel portion of the upper margin past the rotating brush 136, as well as the movements of the other portions of the upper margin past the rotating brush as described below, the brush must move upwardly and downwardly in accordance with the elevation of the portion of the upper margin being roughed and must move forwardly and rearwardly so as to be positioned the desired distance inwardly of the outer periphery of the upper margin being roughed. In addition, the central plane of the brush 136, indicated by the chain line 164 in FIG. 11A, should be tilted during the movement of the portions of the upper margin being roughed past the brush 136 so as to be at right angles to the plane of the portion of the upper margin 154 being roughed. These upward-downward, forward-rearward and tilting movements of the brush 136 are accomplished by the mechanisms disclosed in application Ser. No. 608,616.

After the turntable 16 has rotated 180 degrees to enable the heel portion of the upper margin 154 from one breast line portion to the other breast line portion to be roughed by the tool 136, the turntable 16, by mechanism shown in application Ser. No. 608,616, is caused to cease its rotation and to be locked against rotation. This is followed by a first linear movement of the slide 18 with respect to the stationary turntable 16 lengthwise past the brush 136 so that the brush 136 engages a first side portion 166 (FIG. 10A) of the upper margin 154 as the shoe assembly moves in a heel to toe direction past the brush 136 to thereby enable the brush to rough the first side portion 166 of the upper margin.

By means of mechanism shown in application Ser. No. 608,616, the extent of the first linear movement of the slide is determined by the position of engagement of the toe stop 156 with the toe end of the assembly pursuant to the movement of the stand 36 towards the post 24 by the motor 28 so that the first linear movement of the slide 18 is terminated when the approximate center of curvature of the toe portion of the shoe assembly, indicated by the number 168 in FIG. 10A, is in registry with the axis of rotation of the turntable 16. Upon termination of the first linear movement of the slide 18, the turntable 16 is again unlocked for rotation and is caused to have imparted thereto a second 180° rotation about the axis 168 so that the toe portion of the upper margin 154 is swung past the brush 136 and is roughed.

After the completion of the second 180° rotation of the turntable 16, by mechanism shown in application Ser. No. 608,616, the turntable 16 is caused to cease its rotation and be locked against rotation. This is followed by a second linear movement of the slide 18 with respect to the stationary turntable 16 in a direction that is opposite to the direction of the first linear movement to bring the slide 18 back to its idle end position in the turntable 16. Pursuant to the second linear movement of the slide 18, the shoe assembly moves past the brush 136 so that the brush 136 engages the second side portion 170 (FIG. 10A) of the upper margin 154 as the shoe assembly moves in a toe to heel direction past the brush 136 and the brush 136 thus roughs the second side portion 170 of the shoe assembly.

Upon termination of the second linear movement of the slide 18, the machine parts are returned to their idle positions and the machine cycle is completed. The shoe assembly, with the roughed upper margin, is now removed from the machine.

It is desirable, in accordance with accepted shoe making practice, to have the brush 136 rough the upper margin 154 a relatively short distance inwardly of the outer periphery of the upper margin. It is for this reason that, in the idle position of the machine, the motor 126 is so actuated as to cause the brush 136 to be in a relatively rearward position with respect to the sensinf member 146.

As shown in FIG. 10A, the outer side portion 172 and the inner side portion 174 of the shoe assembly bottom and the side portions 166 and 170 of the upper margin are concave. As shown in FIG. 11, it is the downwardly facing portion of the rotating brush 136 that roughs the upper margin 154 during the movement of the upper margin past the brush. Looking from above at the upwardly facing bottom of the shoe assembly, during the linear movements of the side portions 172 and 174 of the shoe assembly past the brush 136 the central plane 164 of the brush is approximately at right angles to the longitudinal center line of the shoe assembly as indicated in FIG. 10A. Because of this, if the downwardly facing portion of the rotary brush is spaced the relatively short distance inwardly of the outer periphery of the upper margin referred to in the preceding paragraph when roughing the concave side portions 166 and 170 of the upper margin 154, there is a tendency of the brush to rough the bottom 176 of the side (FIG. 11) of the upper 150 where the upper side joins the upper margin 154. Such roughing of the side 176 of the upper 150 is undesirable as it would be visible in the finished shoe. In order to avoid this undesirable roughing of the bottom sides 176 of the upper 150, the brush 136 is moved forwardly relative to the sensing member 146 during the movements of the upper margin side portions 166 and 170 past the roughing brush 136 in the manner described below to thereby enable the brush to rough these side portions a relatively great distance inwardly of the outer periphery of the upper margin.

The valve 90 and the motor 126 are so connected to each other and to a source of air under pressure that when the valve 90 is open the piston rod 128 is retracted into the motor 126 to position the brush 136 in a relatively rearward position with respect to the sensing member 146, as in the idle position of the machine. When the valve 90 is closed by one of the cams of the cam bank 93, as described below, the connections between the valve 90, the motor 126 and the source of air under pressure are such as to cause the motor 126 to project the piston rod 128 to a position wherein the bar 118 engages the front stop 120 in which position the brush 136 is in a relatively forward position with respect to the sensing member 146.

During each of the aforementioned 180 degree rotations of the turntable 16, the cam follower 60 engaged on or the other of the cams 42 which caused the cam follower, together with the rack 50, to move upwardly and then downwardly in the post 48. The upward movement of the rack 50 caused the pinion 62 to rotate an amount sufficient to cause the clutch 64 to rotate the rod 44 through an arc of 90 degrees and thereby position one of the cams 86 or 88 in registry with the valve actuator 92. The downward movement of the rack 50 did not cause the one way clutch 64 to impart rotation to the rod 44.

As can be seen in FIG. 10A, the concave portion 172 on the outer side of the shoe assembly is shorter than the concave side portion 174 on the inner side portions of the shoe assembly. The cams 86 correspond in length to the length of the outer concave side portion 172 and the cams 84 correspond in length to the length of the inner concave side portion 174.

During the first 180 degree rotation of the turntable 16, the cam follower 60 is moved upwardly and downwardly by engaging and moving past one of the cams 42 to thereby impart such 90 degree rotation of the rod 44 as to bring one of the cams 86 into registry with the valve actuator 92. During the linear movements of the slide 18, the cam bank 93 moves along the rod 44 in unison with the slide 18 by virtue of the members 78, 82 and 84 connecting the slide and the cam bank. As a result, during the first linear heel to toe movement of the slide 18 and the shoe assembly past the brush 136, the cam 86 in registry with the valve actuator 92 first engages the valve actuator 92 to close the valve 90 and then moves past and is disengaged from the valve actuator 92 to enable the valve 90 to open. Therefore, during the first linear movement of the slide 18, the motor 126 is first actuated to move the brush 136 to its relatively forward position with respect to sensing member 146 and then is actuated to move the brush 136 back to its relatively rearward position with respect to the sensing member 146. The machine parts are so dimensioned and located that the brush 136 is in its relatively forward position with respect to the sensing member 146 during the movement of the outer side portion 166 of the upper margin 154 past the brush 136 to thereby enable the margin side portion 166 to be roughed a relatively great distance inwardly of the outer margin periphery.

During the second 180 degree rotation of the turntable 16, the cam follower 60 is again moved upwardly and downwardly by engaging and moving past the other of the cams 42 to thereby again impart 90° rotation to the rod 44 so as to bring one of the cams 88 into registry with the valve actuator 92. As a result, during the second linear toe to heel movement of the slide 18 and the shoe assembly past the brush 136, the cam 88 in registry with the valve actuator 92 first engages the valve actuator 92 to close the valve 90 and then is moved past and is disengaged from the valve actuator 92 to enable the valve 90 to open. Therefore, during the second linear movement of the slide 18, the motor 126 is first actuated to move the brush 136 to its relatively forward position with respect to the sensing member 146 and then is actuated to move the brush 136 back to its relatively rearward position with respect to the sensing member 146. The machine parts are so dimensioned and located that the brush 136 is in its relatively forward position with respect to the sensing member 146 during the movement of the inner side portion 170 of the upper margin 154 past the brush 136 to thereby also enable the margin side portion 170 to be roughed a relatively great distance inwardly of the outer margin periphery.

From the foregoing it can be seen that the margin side portions 166 and 170 that are roughed relatively great distances inwardly of the outer margin periphery and the shoe assembly bottom periphery are laterally offset from each other, that is they are offset from each other in directions that are parallel to the longitudinal or heel-toe axis of the shoe assembly.

In the idle position of the machine, the stand 36 is in an idle stand position and the cam bank 93 is in an idle cam bank position. Pursuant to the operation of the motor 28, the cam bank 93 is moved in a toe to heel direction with respect to the shoe assembly until this movement is terminated by the engagement of the toe stop 156 with the toe end of the shoe assembly at which time the stand 36 is in a working stand position and the cam bank 93 is in a working cam bank position. Due to the machine construction disclosed in application Ser. No. 608,616, for a particular length shoe assembly, the extent of the first and second linear movements of the shoe assembly past the brush 136 is proportional to the distance between the working stand position and the post 24. For a particular length shoe assembly, the extent of the linear heel to toe movement of the shoe assembly past the brush 136 during the first linear movement before one of the cams 86 engages the valve actuator 92 to cause the brush 136 to be moved to its relatively forward position is equal to the distance in heel-toe directions between the cam bank working position and the valve actuator 92. For a particular length shoe assembly, the extent of linear toe to heel movement of the shoe assembly past the brush 136 during the second linear movement before one of the cams 88 is disengaged from the valve actuator 92 to cause the brush 136 to be moved to its relatively rearward position is also equal to the distance in heel-toe directions between the cam bank working position and the valve actuator 92.

In changing the machine from operation on a first shoe assembly to a second shoe assembly having a different overall length than the first shoe assembly, the distance in heel-toe directions between the working stand position and the post 24 is greater for the second shoe assembly if the second shoe assembly has a greater overall length than the first shoe assembly, and this distance is less for the second shoe assembly than for the first shoe assembly, if the second shoe assembly is shorter than the first shoe assembly, by amounts that are equal to the increase or decrease in overall length of the second shoe assembly relative to the first shoe assembly. Therefore, the extent of the first and second linear movements of the second shoe assembly past the brush 136 is increased or decreased relative to the corresponding movements of the first shoe assembly by an amount that is equal to the increase or decrease of the overall length of the second shoe assembly with respect to the first shoe assembly.

As stated above, during the first 180 degree rotation of the turntable 16 the heel portion of the margin 154 is roughed between its breast line portions. The increase or decrease of the distance in heel-toe directions from the breast line portions to the heelward ends of the concave side portions 172 and 174 of the second shoe assembly from the corresponding portions of the first shoe assembly is less than the increase or decrease of the overall length of the second shoe assembly from the first shoe assembly. Therefore the increase or decrease in distance between the working cam bank position and the valve actuator 92 for the second shoe assembly relative to the first shoe assembly should be more than the increase or decrease in the overall length of the second shoe assembly with respect to the first shoe assembly.

In order to establish this relationship in the changes in distances between the working stand position and the post 24 and between the working cam position and the valve actuator 92 when changing the overall length of the shoe assembly, the motor 28 moves the cam bank 93 towards the valve actuator 92 at a faster speed than it moves the stand 36 towards the post 24.

A knob 178 is secured to the end of the rod 44 remote from the clutch 64 by which the operator may manually rotate the rod 44, as permitted by the clutch 64, to thereby move a desired cam in the cam bank 93 into registry with the valve actuator 92.

There follows a recapitulation of the machine parts and the mode of operation of the machine that are pertinent to this invention.

The machine is intended to rough the margin 154 of the upper 150 of the shoe assembly comprised of the last 148 having the insole 152 located on its bottom and the upper mounted thereon with the upper margin 154 lying against and being secured to the insole periphery. The machine comprises: the housing 108; the roughing tool 136 mounted to the housing for forward-rearward movement; drive means comprised of the motor 126 for moving the roughing tool between forward and rearward positions with respect to the housing; the turntable 16 mounted for rotary movement about an upright axis; the slide 18 mounted to the turntable for movement in two opposite prone directions between two end positions on the turntable; a shoe assembly support comprised of the last pin 26 and the toe pad 38 mounted to the slide for supporting the shoe assembly bottom-up; means shown in application Ser. No. 608,616 for first moving the turntable, while the turntable is stationary, in a first of said directions between said end positions so as to move a first side portion of the upper margin past the roughing tool; means shown in application Ser. No. 608,616 for thereafter rotating the turntable 180° while the slide is stationary relative to the turntable to move an end portion of the upper margin past the roughing tool; and means shown in application Ser. No. 608,616 for thereafter moving the slide with respect to the turntable, while the turntable is stationary, in the other of said directions between said end positions to move the second side portion of the upper margin past the roughing tool. Operating means shown in application Ser. No. 608,616, which includes the sensing member 146, is effective during the movements of the upper margin portions past the roughing tool to cause such movements of the housing as to enable the roughing tool to engage the upper margin a relatively great distance inwardly of the periphery of the shoe assembly bottom when the roughing tool is in its forward position and to enable the roughing tool to engage the upper margin a relatively small distance inwardly of the periphery of the shoe assembly bottom when the roughing tool is in its rearward position. A control member, in the form of the valve 90 and its actuator 92, is mounted to the turntable. An actuating member, in the form of the cam bank 93, is mounted for movement with the slide in said directions, these members being so constructed and arranged as to be in non-intersecting relationship at the beginning of the slide movement in the first of said directions and at the end of the slide movement in the other of said directions and to be in intersecting relationship during a first prescribed portion of the slide movement in the first of said directions and during a second prescribed portion of the slide movement in the other of said directions, the first and second prescribed portions of the slide movements being laterally offset from each other in that they are offset from each other in directions extending parallel to the longitudinal or heel-toe axis of the shoe assembly. An adjusting means so connects the control member and the actuating member as to cause the drive means to place the roughing tool in one of its positions, disclosed as the rearward position, when the members are in non-intersecting relationship and to place the roughing tool in the other of its positions, disclosed as the forward position, when the members are in non-intersecting relationship.

The control member 90, 92 acts as a normally open regulator movable between open and closed position. The cam bank 93 includes two cams 86 and 88 of different lengths that are selectively movable into registration with the regulator. The non-intersecting relationship takes place when the cam of the cam bank that is in registry with the regulator is disengaged from the regulator, which takes place at the beginning and the end of each of the slide movements. The intersecting relationship takes place when the cam of the cam bank that is in registry with the regulator is in engagement with the regulator and thereby moves the regulator to its closed position, which takes place during the remainder of each of the slide movements. Moving means, comprised of the members 60, 50, 62, 64, and 44 so move the cam bank as to present a different cam into registry with the regulator between the slide movements.

The turntable 16 is rotatably mounted to the base 14 and the moving means comprises the base cam 42 mounted to the base, the cam follower 60 so mounted to the turntable 16 as to intersect the base cam during the turntable rotation, and means formed by the members 50, 62, 64, and 44 that are responsive to the intersection of the cam follower with the base cam to move the cam back to present the different cam into registration with the regulator.

The rod 44 is rotatably mounted to the turntable 16 and the cam bank 93 is so mounted to the rod 44 as to rotate in unison with the rod. Connecting means comprised of the members 78, 82 and 84 so connect the cam bank and the slide as to enable the cam bank to move along the rod during the slide movements to thereby provide the mounting of the cam bank for movement with the slide. Means formed by the spring 52 yieldably urge the cam follower 60 downwardly so as to enable the cam follower to bear against the base and move in heightwise directions first upwardly and then downwardly responsive to the intersection of the cam follower 60 with the base cam 42. The moving means further comprises means formed by the members 50, 62, and 64 that so connect the cam follower to the rod as to rotate the rod an amount sufficient to present the different cam into registry with the regulator in response to movement of the cam follower in one of its heightwise directions.

The post 24 is rigidly mounted to the slide 18 and a backpart shoe assembly supporting element, constituted by the last pin 26, for supporting the backpart of the shoe assembly, is mounted to the post. The stand 36 is mounted to the slide 18 for movement towards and away from the post and a forepart shoe assembly supporting element, constituted by the toe pad 38, for supporting the forepart of the shoe assembly is mounted to the stand. The motor 28 forms means for moving the stand towards the post from an initial stand position to a working stand position a distance that is inversely proportional to the length of a shoe assembly that is supported on the backpart supporting element to thereby enable the forepart supporting element to be placed in a supportive position with respect to the forepart of the shoe assembly. Co-operative terminating means disclosed in application Ser. No. 608,616 are mounted to the stand and to the turntable that define the end position reached at the end of the movement of the slide 18 with respect to the turntable 16 in the first of the directions referred to above. The movement of the slide in this first direction moves the first side portion of the upper margin in such a manner that relative movement extending from the heel of the shoe assembly towards the toe of the shoe assembly of the roughing tool with respect to the upper margin takes place. The rotation of the turntable moves the toe portion of the upper margin past the roughing tool. The movement of the slide in the aforementioned other direction moves the other side portion of the upper margin past the roughing tool in such a manner that relative movement extending from the toe of the shoe assembly towards the heel of the shoe assembly of the roughing tool with respect to the upper margin takes place. A first rack 70 is secured to the slide 18. A second rack 78 is movably mounted to the stand 36 for movement in directions that are parallel to the aforementioned opposite prone directions. A gear train, comprised of the gears 72 and 76, so connects the racks as to cause the second rack to move towards the post during the movement of the stand towards the post at a greater speed than the speed of movement of the stand towards the post. The cams 86 and 88 are connected by the members 82 and 84 to the second rack for movement in unison therewith.

I claim:

1. A machine for roughing the margin of an upper of a shoe assembly, said shoe assembly comprising a last having an insole located on its bottom and the upper mounted thereon with the upper margin lying against and being secured to the insole periphery, comprising: a housing; a roughing tool mounted to the housing for forward-rearward movement; drive means for moving the roughing tool between forward and rearward positions with respect to the housing; a turntable mounted for rotary movement about an upright axis; a slide mounted to the turntable for reciprocal movement in two opposite prone directions between two end positions on the turntable; a shoe assembly support mounted to the slide for supporting the shoe assembly bottom-up; means for first moving the slide with respect to the turntable, while the turntable is stationary, in a first of said directions between said end positions so as to move a first side portion of the upper margin past the roughing tool; means for thereafter rotating the turntable 180° while the slide is stationary relative to the turntable to move an end portion of the upper margin past the roughing tool; means for thereafter moving the slide with respect to the turntable, while the turntable is stationary, in the other of said directions between said end positions to move the second side portion of the upper margin past the roughing tool; operating means effective during said movements of said upper margin portions past the roughing tool to cause such movements of the housing as to enable the roughing tool to engage the upper margin a relatively great distance inwardly of the periphery of the shoe assembly bottom when the roughing tool is in said forward position and to enable the roughing tool to engage the upper margin a relatively small distance inwardly of the periphery of the shoe assembly bottom when the roughing tool is in said rearward position; a control member mounted to the turntable; an actuating member mounted for movement with the slide in said directions; said members being so constructed and arranged as to be in non-intersecting relationship at the beginning of the slide movement in said first of said directions and at the end of the slide movement in said other of said directions and to be in intersecting relationship during a first prescribed portion of the slide movement in said first of said directions and during a second prescribed portion of the slide movement in said other of said directions with said first and second prescribed portions of the slide movements being laterally offset from each other; and adjusting means so connecting said members to the drive means as to cause the drive means to place the roughing tool in one of said positions when said members are in non-intersecting relationship and to place the roughing tool in the other of said positions when said members are in intersecting relationship.

2. The machine of claim 1 wherein said adjusting means is so constructed and arranged as to cause the drive means to place the roughing tool in said rearward position when said members are in non-intersecting relationship and to place the roughing tool in said forward position when said members are in intersecting relationship.

3. A machine for roughing the margin of an upper of a shoe assembly, said shoe assembly comprising a last having an insole located on its bottom and the upper mounted thereon with the upper margin lying against and being secured to the insole periphery, comprising: a housing; a roughing tool mounted to the housing for forward-rearward movement; drive means for moving the roughing tool between forward and rearward positions with respect to the housing; a turntable mounted for rotary movement about an upright axis; a slide mounted to the turntable for reciprocal movement in two opposite prone directions between two end positions on the turntable; a shoe assembly support mounted to the slide for supporting the shoe assembly bottom-up; means for first moving the slide with respect to the turntable, while the turntable is stationary, in a first of said directions between said end positions so as to move a first side portion of the upper margin past the roughing tool; means for thereafter rotating the turntable 180° while the slide is stationary relative to the turntable to move an end portion of the upper margin past the roughing tool; means for thereafter moving the slide with respect to the turntable, while the turntable is stationary, in the other of said directions between said end positions to move the second side portion of the upper margin past the roughing tool; operating means effective during said movements of said upper margin portions past the roughing tool to cause such movements of the housing as to enable the roughing tool to engage the upper margin a relatively great distance inwardly of the periphery of the shoe assembly botton when the roughing tool is in said forward position and to enable the roughing tool to engage the upper margin a relatively small distance inwardly of the periphery of the shoe assembly bottom when the roughing tool is in said rearward position; a normally open regulator, movable between open and closed positions, mounted to the turntable; a cam bank mounted for movement with the slide in said directions, said cam bank including at least two cams of different lengths that are selectively movable into registry with the regulator; means so locating the regulator and the cam bank as to enable the cam that is in registry with the regulator to be disengaged from the regulator at the beginning and the end of each of said slide movements and to be in engagement with the regulator and thereby move the regulator to its closed position during the remainder of each of said slide movements; moving means for so moving the cam bank as to present a different cam into registry with the regulator between said slide movements; and adjusting means so connecting the regulator to the drive means as to place the roughing tool in said rearward position when the regulator is in said open position and as to place the roughing tool in said forward position when the regulator is in said closed position.

4. The machine of claim 3 further comprising: a base to which the turntable is rotatably mounted; and wherein said moving means comprises: a base cam mounted to said base; a cam follower so mounted to the turntable as to intersect the base cam during the turntable rotation; and means responsive to the intersection of the cam follower with the base cam to move the cam bank as aforesaid.

5. The machine of claim 4, further comprising: a rod rotatably mounted to the turntable to which said cam bank is so mounted as to rotate in unison with the rod and as to be movable along the rod; connecting means so connecting the cam bank and the slide as to enable the cam bank to move along the rod during the slide movements to thereby provide said mounting of the cam bank for movement with the slide; and means yieldably urging the cam follower downwardly so as to enable the cam follower to bear against the base and move in heightwise directions first upwardly and then downwardly responsive to said intersection of the cam follower with the base cam; and wherein said moving means further comprises: means so connecting the cam follower to the rod as to rotate the rod an amount sufficient to present said different cam into registry with the regulator in response to movement of the cam follower in one of said heightwise directions.

6. A machine for roughing the margin of an upper of a shoe assembly, said shoe assembly comprising a last having an insole located on its bottom and the upper mounted thereon with the upper margin lying against and being secured to the periphery of the insole, comprising: a housing; a roughing tool mounted to the housing for forward-rearward movement; drive means for moving the roughing tool between forward and rearward positions with respect to the housing; a turntable mounted for rotary movement about an upright axis; a slide mounted to the turntable for reciprocal movement in two opposite prone directions between two end positions on the turntable; a post rigidly mounted to the slide; a backpart shoe assembly supporting element, for supporting the backpart of the shoe assembly bottom-up, mounted to the post; a stand mounted to the slide for movement towards and away from the post; a forepart shoe assembly supporting element, for supporting the forepart of the shoe assembly bottom-up, mounted to the stand; means for moving the stand towards the post from an initial stand position to a working stand position through a distance that is inversely proportional to the length of a shoe assembly that is supported on the backpart supporting element to thereby enable the forepart supporting element to be placed in a supportive position with respect to the forepart of the shoe assembly; co-operative terminating means mounted to the stand and to the turntable for defining one of said end positions; means for first moving the slide with respect to the turntable while the turntable is stationary in a first of said directions between said end positions to an end position defined by said terminating means so as to move a first side portion of the upper margin past the roughing tool in such a manner that relative movement extending from the heel of the shoe assembly towards the toe of the shoe assembly of the roughing tool with respect to the upper margin takes place; means for thereafter rotating the turntable 180 degrees while the slide is stationary relative to the turntable to move the toe portion of the upper margin past the roughing tool; means for thereafter moving the slide with respect to the turntable, while the turntable is stationary, in the other of said directions between said end positions so as to move the other side portion of the upper margin past the roughing tool in such a manner that relative movement extending from the toe of the shoe assembly towards the heel of the shoe assembly of the roughing tool with respect to the upper margin takes place; operating means effective during said movement of the upper margin portions past the roughing tool to cause such movements of the housing as to enable the roughing tool to engage the upper margin a relatively great distance inwardly of the periphery of the shoe assembly bottom when the tool is in said forward position and to enable the roughing tool to engage the upper margin a relatively small distance inwardly of the periphery of the shoe assembly bottom when the tool is in said rearward position; a normally open regulator, movable between open and closed positions, mounted to the turntable; a first rack secured to the slide; a second rack mavably mounted to the stand for movement in directions that are parallel to said opposite prone directions; a gear train so connecting said racks as to cause the second rack to move towards the post during the movement of the stand towards the post at a greater speed than the speed of movement of the stand towards the post; a cam connected to the second rack for movement in unison therewith; said cam and said regulator being so arranged that the cam is disengaged from the regulator at the beginning of the slide movement in said first of said directions and at the end of the slide movement in the other of said directions and the cam is in engagement with the regulator to thereby move the regulator to closed position during a first prescribed portion of the slide movement in said first of said directions and during a second prescribed portion of the slide movement in said other of said directions; and adjusting means so connecting the regulator to the drive means as to place the roughing tool in one of its positions when the regulator is in said open position and as to place the roughing tool in the other of its positions when the regulator is in said closed position.

7. A machine for roughing the margin of an upper of a shoe assembly, said shoe assembly comprising a last having an insole located on its bottom and the upper mounted thereon with the upper margin lying against and being secured to the insole periphery, comprising: a housing; a roughing tool mounted to the housing for forward-rearward movement; drive means for moving the roughing tool between forward and rearward positions with respect to the housing; a turntable mounted for rotary movement about an upright axis; a slide mounted to the turntable for reciprocal movement in two opposite prone directions between two end positions on the turntable; a shoe assembly support mounted to the slide for supporting the shoe assembly bottom-up; means for first moving the slide with respect to the turntable, while the turntable is stationary, in a first of said directions between said end positions so as to move a first side portion of the upper margin past the roughing tool; means for thereafter rotating the turntable 180 degrees while the slide is stationary relative to the turntable to move an end portion of the upper margin past the roughing tool; means for thereafter moving the slide with respect to the turntable, while the turntable is stationary, in the other of said directions between said end positions to move the second side portion of the upper margin past the roughing tool; operating means effective during said movements of said upper margin portions past the roughing tool to cause such movements of the housing as to enable the roughing tool to engage the upper margin a relatively great distance inwardly of the periphery of the shoe assembly bottom when the roughing tool is in said forward position and to enable the roughing tool to engage the upper margin a relatively small distance inwardly of the periphery of the shoe assembly bottom when the roughing tool is in said rearward position; a normally open regulator, movable between open and closed positions, mounted to the turntable; a cam assembly mounted for movement with the slide in said directions; means so locating the regulator and the cam assembly as to enable the cam assembly to be disengaged from the regulator at the beginning and the end of each of said slide movements and to be in engagement with the regulator and thereby move the regulator to closed position during the remainder of each of said slide movements; and adjusting means so connecting the regulator to the drive means as to place the roughing tool in said rearward position when the regulator is in said open position and as to place the roughing tool in said forward position when the regulator is in said closed position.

* * * * *

UNITED STATES PATENT AND TRADEMARK OFFICE

CERTIFICATE OF CORRECTION

PATENT NO. : 3,975,932

DATED : August 24, 1976

INVENTOR(S) : Walter Vornberger

It is certified that error appears in the above-identified patent and that said Letters Patent are hereby corrected as shown below:

Column 2: line 37, change "is" to --in--.
Column 3: line 17, insert --control and-- before "actuating".
Column 4: line 1 of the last complete paragraph, change "20" to --18--;
line 3 of the last complete paragraph, change "26" to --24--.
Column 9: line 14, change "sensinf" to --sensing--;
line 62, change "on" to --one--.
Column 12: change "turntable" beginning at the end of line 33 to --slide--.

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,975,932 Dated August 24, 1976

Inventor(s) Walter Vornberger

It is certified that error appears in the above-identified patent and that said Letters Patent are hereby corrected as shown below:

Column 12: line 33, change "turntable" in the middle of the line to--slide-- and leave unchanged "turntable" that begins at the end of the line.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 3,975,932

DATED : August 24, 1976

INVENTOR(S) : Walter Vornberger

It is certified that error appears in the above-identified patent and that said Letters Patent are hereby corrected as shown below:

Column 10: lines 7, 15 and 22, change "86" to --88--; line 9, change "84" to --86--; lines 43 and 46, change "88" to --86--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*